US010685610B2

(12) United States Patent
Shan

(10) Patent No.: US 10,685,610 B2
(45) Date of Patent: Jun. 16, 2020

(54) DISPLAY DRIVING METHOD AND COMPUTER APPARATUS

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 203 days.

(21) Appl. No.: 15/751,099

(22) PCT Filed: Dec. 8, 2017

(86) PCT No.: PCT/CN2017/115289
§ 371 (c)(1),
(2) Date: Feb. 7, 2018

(87) PCT Pub. No.: WO2019/071783
PCT Pub. Date: Apr. 18, 2019

(65) Prior Publication Data

US 2020/0013351 A1 Jan. 9, 2020

(30) Foreign Application Priority Data

Oct. 10, 2017 (CN) ..... 2017 1 0937006

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 2310/027* (2013.01); *G09G 2320/0242* (2013.01)

(58) Field of Classification Search
None
See application file for complete search history.

(56) References Cited

U.S. PATENT DOCUMENTS

2003/0107681 A1* 6/2003 Otawara ..... G09G 3/2007 348/673
2006/0097971 A1* 5/2006 Lee ..... G09G 3/3648 345/89

(Continued)

FOREIGN PATENT DOCUMENTS

CN 101345036 A 1/2009
CN 102044222 A 5/2011

(Continued)

OTHER PUBLICATIONS

Shan, International Application No. PCT/CN2017/116323, filed on Dec. 15, 2017 and English Translation thereof.

(Continued)

*Primary Examiner* — Sultana M Zalalee
(74) *Attorney, Agent, or Firm* — Kagan Binder, PLLC

(57) ABSTRACT

A driving method for display includes: acquiring an original gray scale data group of each of pixel units of a content to be displayed in a preset display area; determining average gray scales of each of hues in the preset display area according to the original gray scale data group; acquiring original light source intensities of each of the hues of the content to be displayed in the preset display area; dividing the original gray scale data group into a first gray scale data group and a second gray scale data group according to the original gray scale data group of each of the pixel units, the average gray scales of each of the hues, and the original light source intensities, and determining driving light source intensities of each of the hues in the preset display area.

12 Claims, 5 Drawing Sheets

(56) References Cited

U.S. PATENT DOCUMENTS

| | | | | |
|---|---|---|---|---|
| 2006/0279522 | A1* | 12/2006 | Kurihara | G09G 3/3413 345/102 |
| 2009/0167657 | A1* | 7/2009 | Tomizawa | G09G 3/2003 345/88 |
| 2010/0104182 | A1* | 4/2010 | Gondek | G06T 7/00 382/167 |
| 2010/0123401 | A1 | 5/2010 | Park et al. | |
| 2012/0206502 | A1 | 8/2012 | Jung et al. | |
| 2013/0249973 | A1* | 9/2013 | Honbo | G09G 3/342 345/691 |
| 2014/0152724 | A1 | 6/2014 | Park et al. | |
| 2015/0206507 | A1* | 7/2015 | Kwon | G09G 3/3426 345/690 |
| 2015/0379942 | A1 | 12/2015 | Guo et al. | |
| 2016/0117975 | A1* | 4/2016 | Kang | G09G 3/2003 345/694 |
| 2017/0154587 | A1 | 6/2017 | Chen et al. | |
| 2018/0114478 | A1* | 4/2018 | Tien | G09G 3/3614 |
| 2018/0144676 | A1 | 5/2018 | Nadershahi | |
| 2020/0020285 | A1 | 1/2020 | Shan | |
| 2020/0020286 | A1 | 1/2020 | Shan | |
| 2020/0020287 | A1 | 1/2020 | Shan | |
| 2020/0027409 | A1 | 1/2020 | Shan | |

FOREIGN PATENT DOCUMENTS

| | | | |
|---|---|---|---|
| CN | 104299585 | A | 1/2015 |
| CN | 104517576 | A | 4/2015 |
| CN | 104794998 | A | 7/2015 |
| CN | 105096875 | A | 11/2015 |
| CN | 105528999 | A | 4/2016 |
| CN | 106228936 | A | 12/2016 |
| CN | 106873205 | A | 6/2017 |
| CN | 107103881 | A | 8/2017 |
| CN | 107154240 | A | 9/2017 |
| CN | 107657928 | A | 2/2018 |
| CN | 107808647 | A | 3/2018 |
| CN | 107808648 | A | 3/2018 |
| CN | 106057163 | B | 9/2018 |
| EP | 3168836 | A | 5/2017 |
| WO | 2017080299 | A1 | 5/2017 |

OTHER PUBLICATIONS

Shan, International Application No. PCT/CN2017/115246, filed on Dec. 8, 2017 and English Translation thereof.

Shan, International Application No. PCT/CN2017/115264, filed on Dec. 8, 2017 and English Translation thereof.

Shan, International Application No. PCT/CN2017/115165. filed on Dec. 8, 2017 and English Translation thereof.

International Search Report, and English Translation thereof, for International Application No. PCT/CN2017/115289, dated Jul. 18, 2019, (2 pages).

First Chinese Office Action for Chinese Application No. 201710937006.5, dated Mar. 26, 2019 (8 pages).

International Search Report for International Application No. PCT/CN2017/115165, dated Apr. 27, 2018, which U.S. Appl. No. 15/751,545 is a National Stage of (9 pages).

Chinese Office Action for Chinese Application No. 201710935847.2, dated Mar. 8, 2019, which is a counterpart of U.S. Appl. No. 15/751,545 (6 pages).

* cited by examiner

DISPLAY DRIVING METHOD AND COMPUTER APPARATUS

CROSS-REFERENCE TO RELATED APPLICATION

This application claims priority to Chinese Patent Application No. 2017109370065, entitled "DRIVING METHOD, DEVICE AND APPARATUS FOR LIQUID CRYSTAL DISPLAY" filed Oct. 10, 2017, the contents of which are expressly incorporated by reference herein in its entirety.

FIELD OF THE INVENTION

The present disclosure relates to a field of liquid crystal display technology, and particularly relates to a display driving method and a computer apparatus.

BACKGROUND OF THE INVENTION

With the development of science and technology, liquid crystal television, liquid crystal displayer (LCD) and various other liquid crystal display apparatus are increasingly popular and are commonly equipped for residences, malls, office buildings and other places that require information displaying, so as to facilitate the production and life of people.

However, in the color cast change of the side view and front view of each of representative color schemes of a conventional liquid crystal displayer, the side view color casts of schemes of red, green and blue are more severe than other color schemes, moreover, due to the fast escalation and saturation of the view angle brightness ratio of gray scale LCD, the difference between front view brightness and side view brightness is greater as the gray scale is lower.

SUMMARY OF THE INVENTION

Accordingly, it is necessary to provide a display driving method and a computer apparatus that can improve the problem of side view color cast.

A display driving method includes:

acquiring an original gray scale data group of each of pixel units of a content to be displayed in a preset display area;

determining average gray scales of each of hues in the preset display area according to the original gray scale data group;

acquiring original light source intensities of each of the hues of the content to be displayed in the preset display area; and dividing the original gray scale data group into a first gray scale data group and a second gray scale data group according to the original gray scale data group of each of the pixel units, the average gray scales of each of the hues, and the original light source intensities, and determining driving light source intensities of each of the hues in the preset display area; wherein a gray scale of each of the hues of the first gray scale data group is the maximum gray scale in the original gray scale data group; a gray scale of each of the hues of the second gray scale data group is 0 or is greater than a minimum gray scale in the original gray scale data group.

A computer apparatus includes a memory, a processor and a computer program stored on the memory and executable on the processor, wherein the processor executes the computer program to perform following steps:

acquiring an original gray scale data group of each of pixel units of content to be displayed in preset display area;

determining average gray scales of each of hues in the preset display area according to the original gray scale data group;

acquiring original light source intensities of each of the hues of the content to be displayed in the preset display area; and dividing the original gray scale data group into a first gray scale data group and a second gray scale data group according to the original gray scale data group of each of the pixel units, the average gray scales of each of the hues, and the original light source intensities, and determining driving light source intensities of each of the hues in the preset display area;

wherein a gray scale of each of the hues of the first gray scale data group is the maximum gray scale in the original gray scale data group; a gray scale of each of the hues of the second gray scale data group is 0 or is greater than a minimum gray scale in the original gray scale data group.

A display driving method includes:

dividing a display region of a liquid crystal display into at least two display areas, and regarding the display areas as a preset display area sequentially;

acquiring an original gray scale data group of each of pixel units of a content to be displayed in a preset display area;

determining average gray scales of each of hues in the preset display area according to the original gray scale data group;

acquiring original light source intensities of each of the hues of the content to be displayed in the preset display area;

dividing the original gray scale data group into a first gray scale data group and a second gray scale data group according to the original gray scale data group of each of pixel units, the average gray scales of each of the hues, and the original light source intensities, and determining driving light source intensities of each of the hues in the preset display area;

acquiring an original display duration of the original gray scale data group; and continuously displaying the first gray scale data group and the second gray scale data group in the original display duration;

wherein a gray scale of each of the hues of the first gray scale data group is the maximum gray scale in the original gray scale data group; a gray scale of each of the hues of the second gray scale data group is 0 or is greater than a minimum gray scale in the original gray scale data group; upon determining that the second gray scale data group is displayed, the driving light source intensity of the hue corresponding to the maximum gray scale of the average gray scales in the preset display area is set to be 0.

According to the display driving method and the computer apparatus, by dividing the original gray scale data group into a first gray scale data group and a second gray scale data group, the original picture frame signals corresponding to each of pixel units are taken as a multi picture frame combination. And the gray scale of each of the hues of the first gray scale data group is the maximum gray scale in the original gray scale data group; the gray scale of each of the hues of the second gray scale data group is 0 or is greater than a minimum gray scale in the original gray scale data group. Therefore, to highlight the major color and improve color cast, the gray scale data of each of hues are displayed according to the data greater than the minimum gray scale in the original gray scale data group or are directly not displayed, and both of the groups don't contain the data color of the minimum gray scale in the original gray scale data group, thus the brightness difference of the side view low gray scale hue with respect to the overall pixel unit hue is reduced, such that the side view hue is close to the front view hue presentation and an image quality with low color cast is presented.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Figure 1:
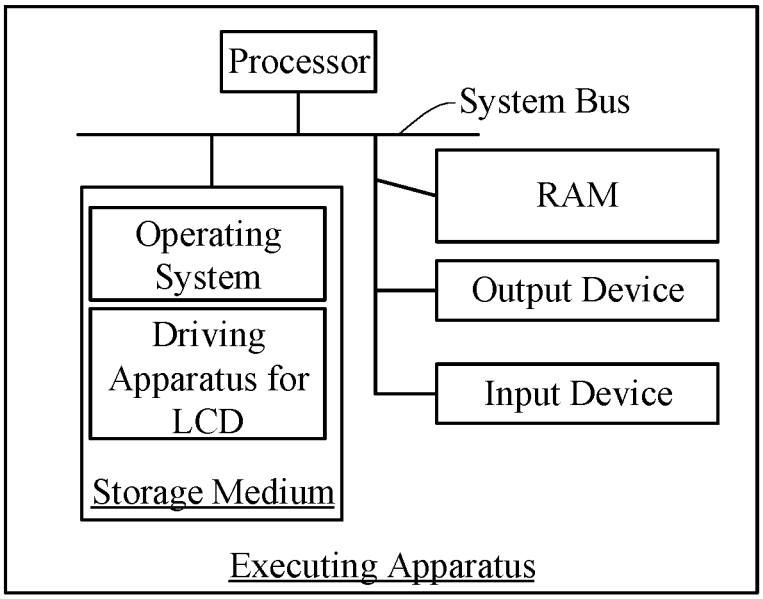
FIG. 1 is a schematic internal structure of an executing apparatus of a display driving method and device according to an embodiment.

The present disclosure will be described in the following with reference to the accompanying drawings and the embodiments. Preferred embodiments are provided in the drawings. The various embodiments of the disclosure may, however, be embodied in many different forms and should not be construed as limited to the specific embodiments set forth hereinafter. Numerous specific details are described hereinafter in order to facilitate a thorough understanding of the present disclosure.

Unless otherwise defined, the technical and scientific terms used herein have the same meaning to the understanding of a person skilled in the art where the present invention pertains. The terms used in the specification of the present invention is for the purpose of describing the embodiments of the present invention, as opposed to limiting thereto. The language "and/or" used in the disclosure refers to any and all combinations of the one or multiple items listed.

FIG. 1 is a schematic internal structure of an executing apparatus of a display driving method and device according to an embodiment. The executing apparatus can be a terminal that implements the display driving method. The executing apparatus includes a processor, a storage medium, a Random-Access Memory (RAM), an output device, and an input device connected through the system bus. An operating system and a computer application program for a liquid crystal display driving device are stored in the storage medium. When the computer application program for the liquid crystal display driving device is executed by the processor, a display driving method is implemented. The processor is configured to provide computation and control capability to support the operation of the executing apparatus. The RAM provides an environment to the computer application program of the liquid crystal display driving device in the storage medium, the RAM has stored computer-readable instructions that, when executed by at least one processors, cause the at least one processor to perform a display driving method. The output device of the executing device can be a display screen, the display screen can be an LCD. The input device can be a touch layer covered on the display screen, a button, a trackball or a touch pad configured on the shell of an electronic apparatus, or an external keyboard, touch pad or mouse and so on. A person skilled in the art should understand, FIG. 1 is exemplary to show the structure of the terminal in accordance with an embodiment of the present disclosure and does not limit the executing apparatus to this embodiment; in other embodiments, compared with the structure shown in FIG. 1, the particular terminal may include more or less components, be configured with other components not shown in FIG. 1, or have a different configuration.

Figure 2:
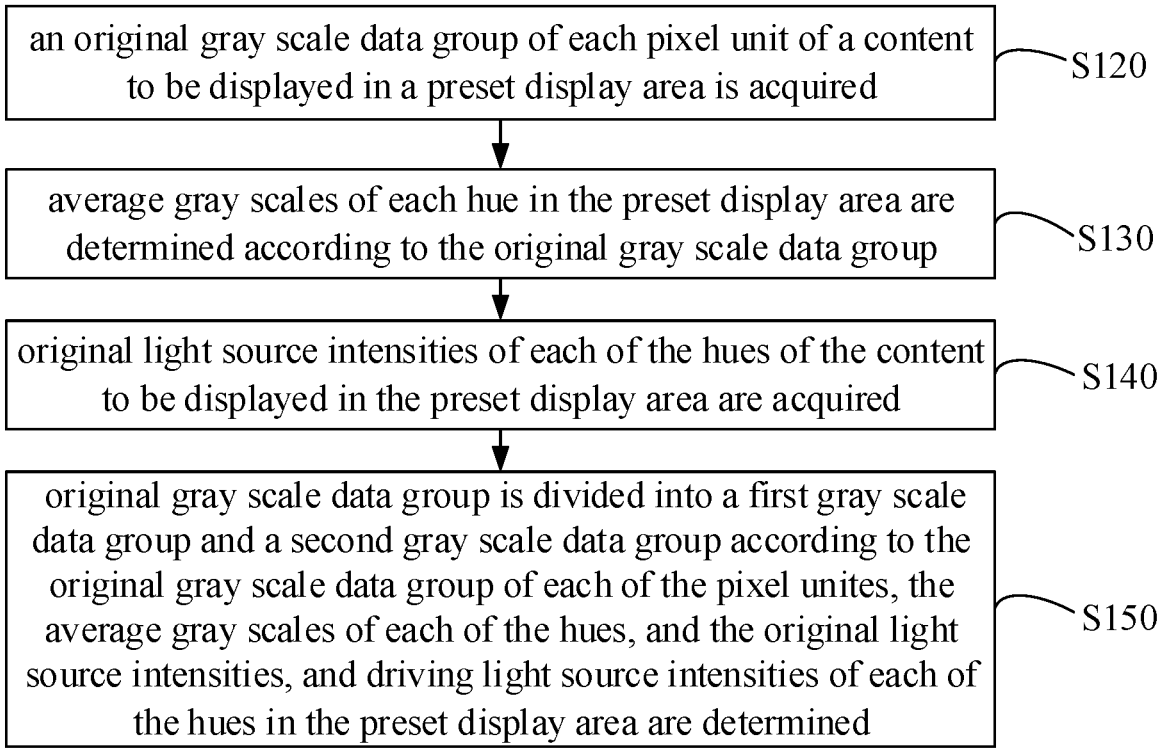
FIG. 2 is a flowchart of a display driving method according to an embodiment.

Referring to FIG. 2, a display driving method is provided, which includes:

In S120: an original gray scale data group of each of pixel units of a content to be displayed in a preset display area is acquired.

The LCD is composed of a plurality of RGB sub-pixel units, each of groups of RGB sub-pixels is called a pixel unit, and each of the pixel units represents an image signal. The original gray scale data group of each of pixel units includes gray scales of three hues of R, G and B, for example, (Rn,m_i,j, Gn,m_i,j, Bn,m_i,j) can represent the original gray scale data group of the pixel unit at column i row j in the display area at column n row m. The display region of LCD can be divided into a plurality of display areas, each of which includes at least two pixel units, the size of display area is customizable, and the LCD can be divided into N (columns)*M (rows) display sections composed by pixel units. Each of the display areas can be regarded as the preset display area in a preset sequence, so as to implement the display driving method.

In S130: average gray scales of each of hues in the preset display area are determined according to the original gray scale data group.

Average gray scales of each of the hues in the preset display area can be determined according to the original gray scale data group of each of pixel units in the preset display area. By respectively summing up each of the hues of the original gray scale data groups in each of pixel units and then dividing by the number of pixel units in the preset display area, the average gray scales of each of hues in the preset display area can be obtained, in other words, the average gray scale group in the preset display area is obtained. For example, (Ave_Rn,m, Ave_Gn,m, Ave_Bn,m) can be used to represent the average gray scale group of the display area at column n and row m.

In S140: original light source intensities of each of the hues of the content to be displayed in the preset display area are acquired.

Via a look-up table, original light source intensities of each of the hues of the content to be displayed in the preset display area are acquired, in other words, an original light source intensity group of the content to be displayed in the preset display area is acquired. It should be understood that the look-up table may be pre-stored in the memory and directly called when needed. The look-up table may also be acquired when needed, so as to acquire the group of the original light source intensities of the content to be displayed in the preset display area. (An, m_R, An, m_G, An, m_B) can be used to present the light source intensity group of the content to be displayed in the display area at column n and row m.

In S150: the original gray scale data group is divided into a first gray scale data group and a second gray scale data group according to the original gray scale data group of each of the pixel units, the average gray scales of each of the hues, and the original light source intensities, and driving light source intensities of each of the hues in the preset display area are determined. A gray scale of each of the hues of the first gray scale data group is the maximum gray scale in the original gray scale data group; a gray scale of each of the hues of the second gray scale data group is 0 or is greater than a minimum gray scale in the original gray scale data group.

The driving light source intensities of R, G and B of the two picture frames in the preset display area are adjusted according to the average gray scales of each of the hues of all pixel units in the preset display area (for example, Ave_Rn,m, Ave_Gn,m, Ave_Bn,m). The original light source intensities An, m_R, An, m_G, An, m_B of hues of R, G and B in the display area (n, m) are adjusted to A'n, m_R, A'n, m_G, A'n, m_B.

According to the previously described display driving method, by dividing the original gray scale data group into a first gray scale data group and a second gray scale data group, the original picture frame signals corresponding to each of pixel units are taken as a multi picture frame combination. And the gray scale of each of the hues of the first gray scale data group is the maximum gray scale in the original gray scale data group; the gray scale of each of the hues of the second gray scale data group is 0 or is greater than a minimum gray scale in the original gray scale data group. Therefore, to highlight the dominant color and improve color cast, the gray scale data of each of hues in the original gray scale data group are displayed according to the data greater than the minimum gray scale or are simply not displayed, and neither of the groups contains the data color of the minimum gray scale in the original gray scale data group, thus the brightness difference of the side view low gray scale hue with respect to the overall pixel unit hue is reduced, such that the side view hue is close to the front view hue in presentation and an image quality with low color cast is presented.

Figure 3:
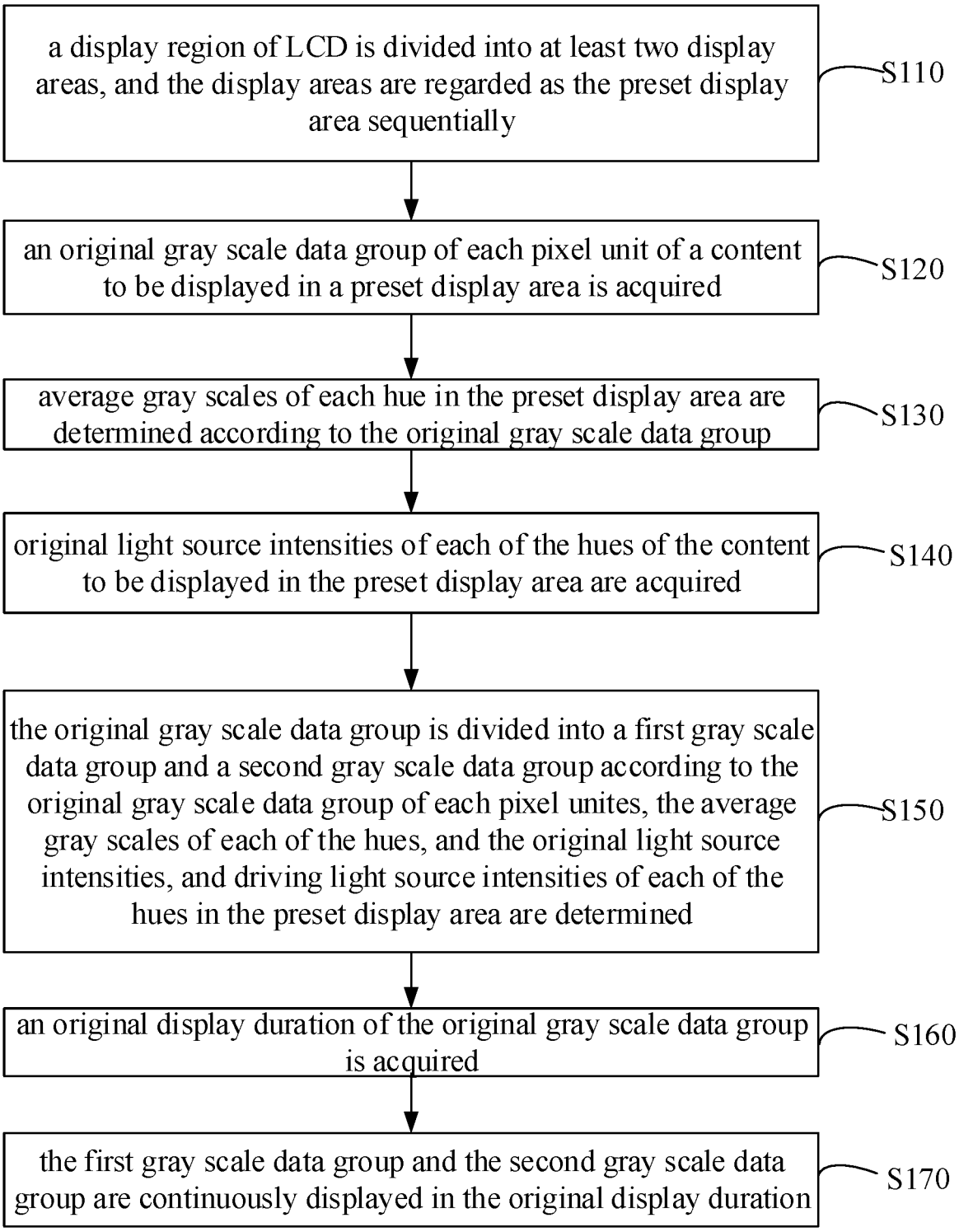
FIG. 3 is a flowchart of a display driving method according to another embodiment.

Referring to FIG. 3, in an embodiment, after the step of dividing the original gray scale data group into a first gray scale data group and a second gray scale data group, the method further includes:

In S160: an original display duration of the original gray scale data group is acquired.

In S170: the first gray scale data group and the second gray scale data group are continuously displayed in the original display duration.

In the illustrated embodiment, a gray scale data group of an original picture frame corresponding to a pixel unit is divided into a first gray scale data group and a second gray scale group of two picture frames (a first picture frame and a second picture frame) corresponding to the pixel unit. A combination of the two picture frames is sequentially presented in time, in other words, the first gray scale data group and the second gray scale data group are sequentially displayed. The original display duration is divided into two time periods, in which the first gray scale data group is displayed in one time period, and the second gray scale data group is displayed in another time period. Preferably, to ensure the display performance, the two time periods are of the same length, in other words, both the lengths are a half of the original display duration.

Figure 4:
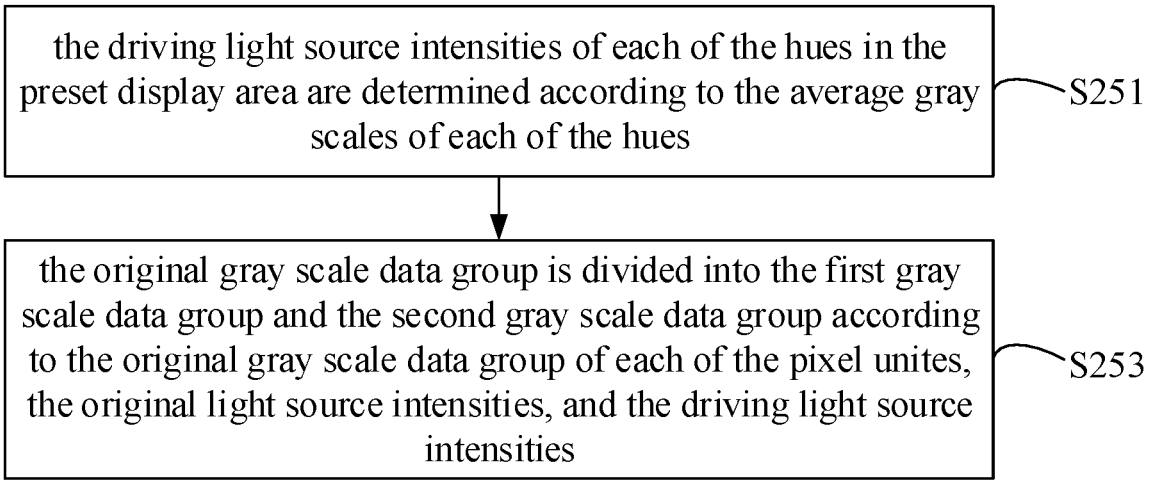
FIG. 4 is a specific flow chart of a step of a display driving method in FIG. 2 or FIG. 3.

Referring to FIG. 4, the step of dividing the original gray scale data group into a first gray scale data group and a second gray scale data group according to the original gray scale data group of each of the pixel units, the average gray scales of each of the hues, and the original light source intensities, and determining driving light source intensities of each of the hues in the preset display area includes:

In S251: the driving light source intensities of each of the hues in the preset display area are determined according to the average gray scales of each of the hues.

According to the average gray scales in the preset display area, it is determined that the maximum gray scale in the average gray scales is a maximum average gray scale sub-pixel with which one of the hues R, G and B as the dominant hue, and it is determined the maximum gray scales of most pixel units are the hues of a sub-pixel of R, G and B. Therefore, the driving light source intensities of each of the hues in the preset display area are determined according to the hue corresponding to the maximum gray scale in average gray scales of each of the hues in the preset display area.

Assume the average gray scales of each of hues of all pixel units in a display area (n,m) are: Ave_Rn,m=A, Ave_Gn,m=B and Ave_Bn,m=C, and A>B>C, then the display area is a red hue combination. The average gray scales (Ave_Rn,m, Ave_Gn,m, Ave_Bn,m) of each of hues of R, G and B are divided into two picture frame gray scale combinations, R1G1B1 combination 1 (the first gray scale data group), and R2G2B2 combination 2 (the second gray scale data group). The gray scales of each of the hues in the R1G1B1 combination 1 are the maximum gray scale in the average gray scales, which is A; i.e., R1=A, G1=A, and B1=A. The gray scales of each of the hues in the R2G2B2 combination 2 are: for the hue corresponding to the maximum average gray scale, R2=0; the gray scales of hue of G2 and B2 are the second maximum average gray scale, which is B, then R2=0, G2=B, and B2=B.

Driving light source intensities A'n, m_R, A'n, m_G, A'n, m_B of each of the hues of R, G and B are calculated according to the first gray scale data group and the second gray scale data group, so as to maintain the overall R, G and B signal brightness as the same as the original picture frame brightness. The driving light source intensities A'n, m_R, A'n, m_G, A'n, m_B of each of the hues of R, G and B are calculated as following:

$$A'n,m_R=2*\mathrm{TR}(A)*An,m_R/(TR(A)+0)=2*An,m_R;$$

$$A'n,m_G=2*TG(B)*An,m_G/(TG(A)+TG(B));$$

$$A'n,m_B=2*TB(C)*An,m_B/(TB(A)+TB(B)).$$

It should be noted that, the brightness ratios corresponding to the average gray scales of each of the hues of R, G and B in the preset display can be acquired via a look-up table, which are TR (A), TG (B), and TB(C), respectively. The brightness ratios corresponding to each of the hues in the first gray scale data group can be acquired via a look-up table, which are TR (A), TG (A), and TB (A), respectively. The brightness ratios corresponding to each of the hues in the second gray scale data group can be acquired by table look-up, which are TR(0)=0, TG (B), and TB(B), respectively. A brightness ratio is a brightness ratio of the gray scale of a respective hue with respect to the full gray scale. It should be understood that, the data tables can be prestored in a memory, a corresponding brightness ratio can be directly acquired when required; otherwise, the data tables can be acquired when required, thus the brightness ratios can be acquired.

In S253: the original gray scale data group is divided into the first gray scale data group and the second gray scale data group according to the original gray scale data group of each of the pixel units, the original light source intensities, and the driving light source intensities.

A first gray scale data group of a first picture frame corresponding to a pixel unit can be determined according to maximum gray scales of each of hues in the original gray scale group of the pixel unit. In combination with the first gray scale data group, the original light source intensities, and the driving light source intensities, according to the principle of brightness conservation, a brightness ratio group of the gray scales of the second picture frame corresponding to the pixel unit with respect to the full gray scale after dividing is acquired, the brightness ratio group includes brightness ratios of each of the hues. It should be understood that, a brightness ratio is a brightness ratio of gray scale of a respective hue with respect to the brightness of the full gray scale. After determining the two brightness ratio groups, gray scales of each of the hues in the first gray scale data group and the second gray scale data group can be determined via a look-up table. It should be noted that, picture frames corresponding to a pixel unit includes the original picture frame of the pixel unit before dividing, the first picture frame and the second picture frame corresponding to the pixel unit after dividing.

Furthermore, the step of dividing the original gray scale data group into the first gray scale data group and the second gray scale data group according to the original gray scale data group of each of the pixel units, the original light source intensities, and the driving light source intensities includes:

(a) the maximum gray scales of each of the hues are regarded as the gray scales of each of the hues of the first gray scale data group.

(b) brightness ratios of the gray scales of each of the hues of the first gray scale group with respect to the full gray scale are determined according to the gray scales of each of the hues of the first gray scale data group.

(c) brightness ratios of the gray scales of each of the hues of the second gray scale group with respect to the full gray scales are determined according to the brightness ratios of the gray scales of each of the hues of the first gray scale group with respect to the full gray scales, the original light source intensities, and the driving light source intensities.

Case 1:

Average gray scales of each of hues of all pixel units in a preset display area are: Ave_Rn,m=A, Ave_Gn,m=B and Ave_Bn,m=C, and A>B>C, then the display area is a red hue combination. In the preset display area, the original gray scale data group of most pixel units is presented as (Rn,m_i,j=A1, Gn,m_i,j=B1, Bn,m_i,j=C1), and most pixel units are red hue combinations that meet A1>B1>C1, then the maximum gray scale in the original gray scale data group of the pixel unit Ri,j, Gi,j, Bi,j is A1, the pixel unit is divided from one picture frame (original picture frame) into a combination of two picture frames (a first picture frame and a second picture frame). After dividing, the gray scales of each of the hues of Ri,j, Gi,j, Bi,j are corresponding to a first gray scale data group R1i,jG1i,jB1i,j and a second gray scale data group R2i,jG2i,jB2i,j, respectively. The gray scales of each of the hues in the first gray scale data group are the maximum gray scale A1 in the original gray scale data group, in other words, R1i,j=A1, G1i,j=A1, B1i,j=A1. Via a look-up table, the brightness ratios of each of the hues in the first gray scale group with respect to the brightness of the full gray scale can be determined as TR(A1), TG(A1), TB(A1). In combination with the original light source intensities An,m_R, An,m_G, An,m_B and the driving light source intensities A'n,m_R, A'n,m_G, A'n,m_B of hues R,G, and B in the preset display area, according to the principle of brightness conservation, brightness ratios TR(R2i,j),TG(G2i,j),TB(B2i,j) of the gray scales of the hues in the second gray scale data group with respect to the full gray scale are acquired, thus via a look-up table, a gray scale of each of hues can be determined according to the brightness ratio. In one specific embodiment, the brightness ratios TR(R2i,j), TG(G2i,j), TB(B2i,j) of the gray scales of the hues in the second gray scale data group with respect to the full gray scale are calculated as following:

$$TR(R2i,j)=(2*An,m_R*TR(A1)-A'n,m_R*TR(A1))/A'n,m_R=0;$$

$$TG(G2i,j)=(2*An,m_G*TG(B1)-A'n,m_G*TG(A1)))/A'n,m_G=((TG(A)+TG(B))/TG(B))*TG(B1)-TG(A1);$$

$$TB(B2i,j)=(2*An,m_B*TB(C1)-A'n,m_B*TB(A1))/A'n,m_B=((TB(A)+TB(B))/TB(C))*TB(C1)-TB(A1).$$

Case 2:

Average gray scales of each of hues of all pixel units in a preset display area are: Ave_Rn,m=A, Ave_Gn,m=B and Ave_Bn,m=C, and A>B>C, thus the display area is a red hue combination. Assume that in the preset display area, the original gray scale data group of one other pixel unit is presented as (R'i,j=A2, G'i,j=B2, B'i,j=C2), the pixel unit is a green hue combination that B2>C2>A2, which is different from the average gray scales in the preset display area in terms of size order. The gray scales of each of hues of the pixel unit R'i,j,G'i,j,B'i,j are changed from one picture frame (the original picture frame) to a combination of two picture frames (a first picture frame and a second picture frame), and are corresponding to a first gray scale data group R'1i,jG'1i,jB'1i,j and a second gray scale data group R'2i,jG'2i,jB'2i,j, respectively. The gray scales of each of the hues in the first gray scale data group are the maximum gray scale B2 in the original gray scale data group, in other words, R'1i,j=B2, G'1i,j=B2, B'1i,j=B2. Via a look-up table, the brightness ratios of each of the hues in the first gray scale group with respect to the brightness of the full gray scale can be determined as TR(B2), TG(B2), TB(B2). Further in combination with the original light source intensities An,m_R, An,m_G, An,m_B and the driving light source intensities A'n,m_R, A'n,m_G, A'n,m_B of hues R,G, and B in the preset display area, according to the principle of brightness conservation, brightness ratios TR(R'2i,j),TG(G'2i,j),TB(B'2i,j) of the gray scales of the hues in the second gray scale data group with respect to the full gray scale is acquired, thus via a look-up table, a gray scale of each of hues can be determined according to the brightness ratio. In one specific embodiment, the brightness ratios TR(R'2i,j),TG(G'2i,j),TB(B'2i,j) of the gray scales of the hues in the second gray scale data group with respect to the full gray scale are calculated as following:

$$TR(R'2i,j)=(2*An,m_R*TR(A2)-A'n,m_R*(TR(B2)))/A'n,m_R=TR(A2)-TR(B2),\ \text{if}\ TR(R'2i,j)>Y,\ TR(R'2i,j)=Y,\ \text{if}\ TR(R'2i,j)<0,\ TR(R'2i,j)=0;$$

$$TG(G'2i,j)=(2*An,m_G*TG(B2)-A'n,m_G*(TG(B2)))/A'n,m_G=((TG(A)+TG(B))/TG(B))*TG(B2)-TG(B2),\ \text{if}\ TG(G'2i,j)>Y,\ TG(G'2i,j)=Y,\ \text{if}\ TG(G'2i,j)<0,\ TG(G'2i,j)=0;$$

$$TB(B'2i,j)=(2*An,m_B*TB(C2)-A'n,m_B*(TB(C2)))/A'n,m_B=((TB(A)+TB(B))/TB(C))*TB(C2)-TB(B2),\ \text{if}\ TB(B'2i,j)>Y,\ TB(B'2i,j)=Y,\ \text{if}\ TB(B'2i,j)<0,\ TB(B'2i,j)=0.$$

It should be noted that, since the size order of the original gray scale data group of the pixel unit is different from the average gray scales of the preset display area, the brightness ratios of the gray scales of each of the hues of the second gray scale group (R'2i,jG'2i,jB'2i,j) with respect to the full gray scales determined by the previously described formulas could be smaller than 0 or be greater than the preset maximum value. Therefore, the calculated values of the brightness ratios TR(R'2i,j),TG(G'2i,j),TB(B'2i,j) of the gray scales of the hues in the second gray scale data group with respect to the full gray scale must be determined. If the calculated value is smaller than 0, then the brightness ratio is set to be 0, if the calculated value is greater than a preset maximum value Y, then the brightness ratio is set as the preset maximum value Y.

In an embodiment, the step of determining driving light source intensities of each of the hues in the preset display area includes: upon determining that the second gray scale data group is displayed,the driving light source intensity of the hue corresponding to the maximum gray scale of the average gray scales in the preset display area is set to be 0.

Since the maximum gray scale of the average gray scales is an average gray scale of one hue in a preset display area, the hue corresponding to the maximum gray scales of most pixel units in the preset display area is consistent with the hue corresponding to the maximum gray scale. And the maximum gray scale is also the gray scale of each of hues of the first gray scale data group, therefore, upon determining that the second gray scale data group is displayed, setting the driving light source intensity of the hue corresponding to the maximum gray scale of the average gray scales in the preset display area to be 0 has little impact on the overall displaying, and also the role of energy-saving emission reduction is performed.

As the previously described case 1 according to an embodiment, the preset display expects the sequence of the gray scales of each of hues in most pixel units is consistent with the sequence of the average gray scales, which is Ave_Rn,m=A, Ave_Gn,m=B, Ave_Bn,m=C, where A>B>C. After dividing the original gray scale data group, the red hue drive light source intensity A'n,m_R of the first gray scale is twice of the original red hue drive light source intensity, in other words, A'n,m_R=2*An,m_R, and the red hue drive light source intensity A'n,m_R of the second gray scale data group can be set to be 0 signal. As the previously described case 2 according to an embodiment, when the preset display expects that there's other pixel units with a size order of each of hues of R'i,j, G'i,j, B'i,j differs from the size order of the average gray scales with Ave_Rn,m=A, Ave_Gn,m=B, Ave_Bn,m=C, where A>B>C. Then the calculated brightness ratios of each of hues of the second gray scale data group calculated according to the original light source intensities, and the drive light source intensities are TR(R'2i,j)=(2*An,m_R*TR(A2)−A'n,m_R*(TR(B2)))/A'n,m_R=TR(A2)−TR(B2), it can be sure that TR(A2)−TR(B2)<0, so the gray scale R'2i,j of red hue of the second gray scale data group can be set to be 0. Since setting the previously described drive light source intensity A'n,m_R of the second gray scale data group to be 0 has little impact on the overall result, the red hue drive light source intensity of the second gray scale data group in the preset display area can be set to be 0 while displaying, in other words, the backlight R LED light source can be turn off, so as to save energy. It should be understood that, in other embodiments, the hue corresponding to the maximum gray scale in the average gray scales can also be green or blue, and not be limited to red according to the previously described embodiment.

Referring to FIG. 3, in an embodiment, prior to the step of acquiring the original gray scale data group of each of pixel units of the content to be displayed in the preset display area, the method further includes:

In S110: a display region of LCD is divided into at least two display areas, and the display areas are regarded as the preset display area sequentially.

Each of display areas can be sequentially regarded as the preset display areas according to a preset sequence, so as to implement the driving method for LCD display. The preset sequence can be a sequence that sorting is firstly performed by rows then performed by columns, or a sequence that sorting is firstly performed by columns then performed by rows. As such, liquid crystal display driving is performed to each of the display areas of the overall LCD, so as to implement the display driving for the overall LCD.

In an embodiment, the step of dividing the original gray scale data group into the first gray scale data group and the second gray scale data group according to the original gray scale data group of each of the pixel units, the average gray scales of each of the hues, and the original light source intensities, and determining the driving light source intensities of each of the hues in the preset display area includes: if the gray scales of each of the hues in the preset display area are the same original gray scale data group, which means that, the average gray scales of each of the hues are the average gray scales of each of the hues of the original gray scale data group. Then the original gray scale data group are divided into the first gray scale data group and the second gray scale data group, where the gray scale of each of the hues of the first gray scale data group is the maximum gray scale in the original gray scale data group, the gray scale of each of the hues of the second gray scale data group is 0 or is a second maximum gray scale in the original gray scale data group; according to the original light source intensities, the first gray scale data group, and the second gray scale data group, the driving light source intensities of each of the hues in the preset display area are determined.

As a particular example, when all the gray scales of each of hues in the preset display area are red hue combination with Ri,j=100, Gi,j=80, Bi,j=40, the original gray scale data group of the original picture frame corresponding to a pixel unit is divided a first gray scale data group (R1,G1,B1), and a second gray scale data group (R2,G2,B2) of two picture frames (a first picture frame and a second picture frame) corresponding to the pixel unit. The gray scales of each of the hues of the first gray scale data group are the maximum gray scale in the original gray scale data group, i.e., 100, which means that R1=100,G1=100,B1=100. The gray scale of each of the hues of the second gray scale data group is 0 or is a second maximum gray scale in the original gray scale data group, particularly, R2=0, G2=80, B2=80. The original gray scale data group is divided into two gray scale data group, and the two gray scale are sequentially presented in time. In other words, the original display duration of the original picture frame signal is equally divided into time periods, one time period presents the first gray scale data group, another time period presents the second gray scale data group.

Assume that the brightness ratios of the front view of the original gray scale data group (Ri,j=100, Gi,j=80, Bi,j=40) of a pixel unit with respect to full gray scale 255 are SR %, LG %, MB %, the corresponding side view brightness ratios are SR'%, LG'%, MB'%, where SR>LG>MB and SR'>LG'>MB'. Since the difference of the front view and side view brightness ratio is greater while the gray scale signal is lower, it should be understood that SR/MB>SR'/MB' and LG/MB>LG'/MB', the color is mixed such that the brightness ratio of the primary brightness signal SR at the front view is greater than that of MB in terms of difference, still, in the case of side view, the brightness ratio of the primary brightness signal SR' is less than that of MB' in terms of difference, the color brightness is reduced as the primary hue color of the front view is affected. In view of the optical-electrical characteristics of conventional VA displays, the brightness variation corresponding to a standard signal is a relation conforming to an exponent 2.2. For example, Y=(X/255)2.2, where Y is a normalization brightness, X is a gray scale (a preferred gray scale is a 8 bit signal between 0 and 255), via a look-up table or that the brightness variation corresponding to the above signal is a relation conforming to the exponent 2.2, it can be determined that SR %=13.3%, LG %=7.4%, MB=1.7%, SR'%=39%, LG'%=34.7%, MB'=23.1%.

Since all the gray scales of the first gray scale data group are 100, via a look-up table, the front view brightness ratios of each of hues of the first picture frame can be respectively determined as 13.3%, 12.1%, 12.1%, and the side view brightness ratios are respectively determined as 39%, 41%, 49%. For the second gray scale data group (R2i,j=0, G2i,j=80, B2i,j=80), via a look-up table the front view brightness ratios of each of hues of the second picture frame can be respectively determined as 0%, 7.4%, 7.4%, and the side view brightness ratios are respectively determined as 0%, 34.7%, 42.1%.

Since the original picture frame is changed from one picture frame to two picture frames in sequence, the picture frame frequency of the displayer needed to be increased by two times, thus a display duration for each of picture frames is a half of the original display duration. Assume the original display duration of the original picture frame is T, and the original display duration is divided into a sum of time periods of two picture frames in sequence, and since the time period of divided picture frame is a half of the time period of the original picture frame, correspondingly, the picture frame light source intensities of the two divided time sequences should be doubled, that is, the drive light source intensities of each of the hues of R, G and B should be increased to twice of the original light sources, so as to maintain the overall brightness as the same as the original picture frame brightness. For hue of R, the original light source intensity is A R, the drive light source intensity is twice of the original light source intensity, i.e. the backlight is A'_R=2*A_R. Furthermore, for the brightness ratio of the hue of G and the hue of B, TG(G1)+TG(G2)=TG(100)+TG(80)=13.3%+7.4%=20.7% is greater than the original brightness ratio of the hue of G TG(80)=7.4%, and TB(B1)+TB(B2)=TB(100)+TB(80)=12.1%+7.4%=19.5% is greater than the original brightness ratio of hue B TB(40)=1.7%, therefore to maintain a brightness conservation of the hue of G and B in a front view, the drive light source intensities of the hue of G and B should be adjusted, thus A'_G=2*A_G*TG(80)/(TG(100)+TG(80))=0.715*A_G, similarly, A'_B=2*A_B*TB(40)/(TB(100)+TB(80))=0.174*A_B.

Since the composite brightness ratios of the combination of the side view picture frames are respectively (39%+0%)*2=78%,(41%+34.7%)*0.715=54.1%, (49%+42.1%)*0.174=15.9%; while brightness ratios of each of hues of Ri,j,Gi,j,Bi,j of the side view of the original picture frame are respectively 39%, 34.7%, 23.1%, accordingly, the brightness ratio of the main hue, R, with respect to hue B is increased from the 39%/23.1%=1.696 of the original picture frame to the 78%/15.9%=4.9 of the combination of picture frames, similarly, the brightness ratio of the main hue, R, with respect to the hue of G is increased from the 39%/34.7%=1.127 of the original picture frame to the 78%/54.1%=1.44 of the combination of picture frames. The combination of picture frames reduces the equivalent brightness of the low-gray scale large-angle view of the original picture frame, so that the main hue is obviously increased with respect to the other hues, such that the side view is relatively close to the presentation of the main hue of the front view. It should be noted that, the main hue is the hue corresponding to the maximum gray scale in the original gray scale data group corresponding to the pixel unit.

Figure 5:
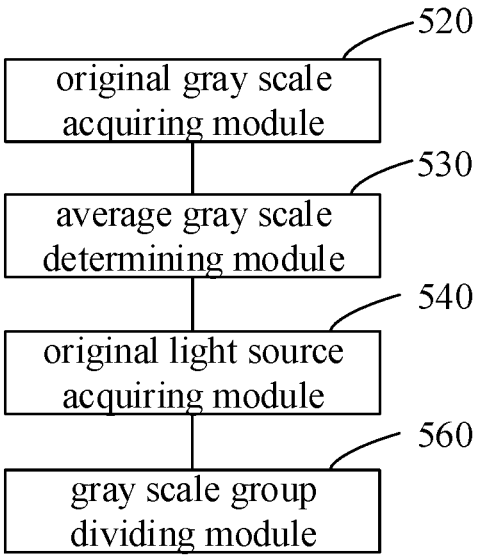
FIG. 5 is a block diagram of a LCD driving device according to an embodiment.

Referring to FIG. 5, an LCD driving device corresponding to previously described method is also provided, which includes:

An original gray scale acquiring module 520 configured to acquire an original gray scale data group of each of pixel units of a content to be displayed in a preset display area;

An average gray scale determining module 530 configured to determine average gray scales of each of hues in the preset display area according to the original gray scale data group;

An original light source acquiring module 540 configured to acquire original light source intensities of each of the hues of the content to be displayed in the preset display area; and A gray scale group dividing module 560 configured to divide the original gray scale data group into a first gray scale data group and a second gray scale data group according to the original gray scale data group of each of the pixel units, the average gray scales of each of the hues, and the original light source intensities, and determine driving light source intensities of each of the hues in the preset display area; a gray scale of each of the hues of the first gray scale data group is the maximum gray scale in the original gray scale data group; a gray scale of each of the hues of the second gray scale data group is 0 or is greater than a minimum gray scale in the original gray scale data group.

According to the previously described display driving device, by dividing the original gray scale data group into a first gray scale data group and a second gray scale data group, the original picture frame signals corresponding to each of pixel units are taken as a multi picture frame combination. And the gray scale of each of the hues of the first gray scale data group is the maximum gray scale in the original gray scale data group; the gray scale of each of the hues of the second gray scale data group is 0 or is greater than a minimum gray scale in the original gray scale data group. Therefore, to highlight the major color and improve color cast, the gray scale data of each of hues are displayed according to the data greater than the minimum gray scale in the original gray scale data group or are directly not displayed, and both of the groups don't contain the data color of the minimum gray scale in the original gray scale data group, thus the brightness difference of the side view low gray scale hue with respect to the overall pixel unit hue is reduced, such that the side view hue is close to the front view hue presentation and an image quality with low color cast is presented.

In an embodiment, the gray scale group dividing module is further configured to set the driving light source intensity of the hue corresponding to the maximum gray scale of the average gray scales in the preset display area be to 0 when it is determined that the second gray scale data group is displaying.

Figure 6:
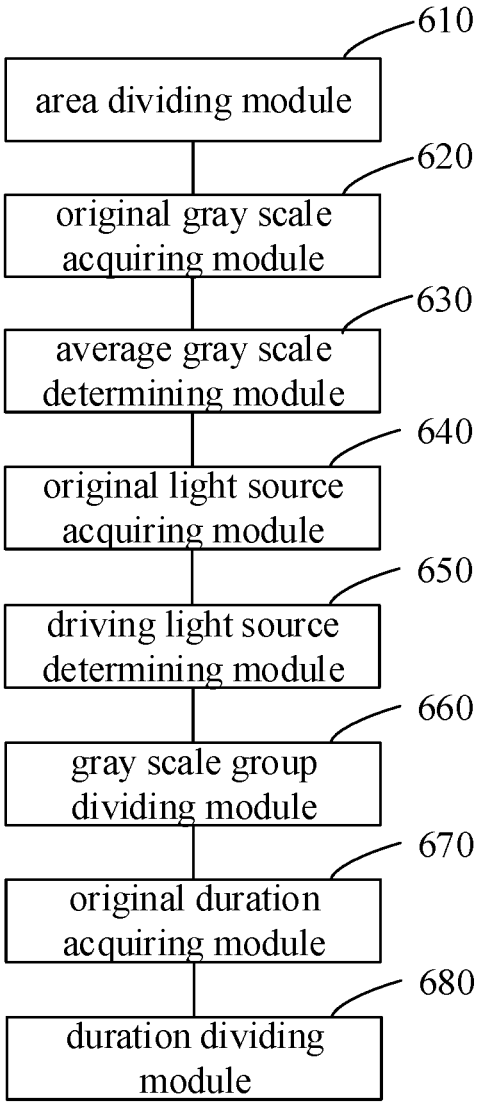
FIG. 6 is a block diagram of a LCD driving device according to another embodiment.

Referring to FIG. 6, in an embodiment, the driving device further includes:

An original duration acquiring module 670 configured to acquire an original display duration of the original gray scale data group; and A duration dividing module 680 configured to continuously display the first gray scale data group and the second gray scale data group in the original display duration.

Referring to FIG. 6 again, in an embodiment, the gray scale group dividing module 560 further includes a driving light source determining sub-module 650 configured to determine the driving light source intensities of each of the hues in the preset display area according to the average gray scales of each of the hues; and A gray scale group dividing sub-module 660 configured to divide the original gray scale data group into the first gray scale data group and the second gray scale data group according to the original gray scale data group of each of the pixel units, the original light source intensities, and the driving light source intensities.

Figure 7:
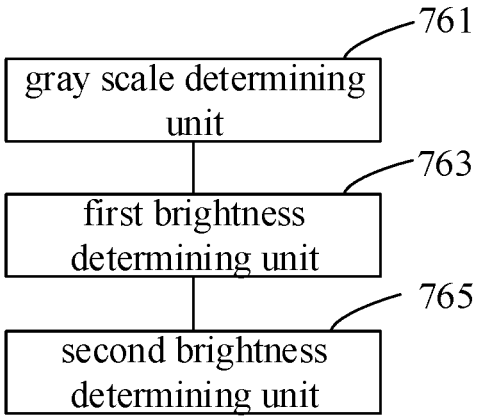
FIG. 7 is a block diagram of a module of a LCD driving device in FIG. 5 or FIG. 6.

Referring to FIG. 7, in an embodiment, the gray scale group dividing sub-module includes:

A gray scale determining unit 761 configured to regard the maximum gray scales of each of the hues as the gray scales of each of the hues of the first gray scale data group;

A first brightness determining unit 763 configured to determine brightness ratios of the gray scales of each of the hues of the first gray scale group with respect to a full gray scales according to the gray scales of each of the hues of the first gray scale data group; and A second brightness determining unit 765 configured to determine brightness ratios of the gray scales of each of the hues of the second gray scale group with respect to the full gray scale according to the brightness ratios of the gray scales of each of the hues of the first gray scale group with respect to all the gray scales, the original light source intensities, and the driving light source intensities.

Referring to FIG. 6 again, in an embodiment, the driving device further includes:

An area dividing module 610 configured to divide a display region of a liquid crystal display into at least two display areas, and regarding the display areas as the preset display area sequentially.

A computer apparatus corresponding to the previously described method is further provided.

A computer apparatus comprising a memory, a processor and a computer program stored on the memory and executable on the processor, and the processor executes the computer program to perform steps of previously described driving method.

As the previously described display apparatus and display driving method are corresponding to each other, with respect to the specific technical features of the apparatus and corresponding to the previously described method are omitted for brevity.

It should be noted that, the display apparatus is, for example, an LCD, an Organic Light-Emitting Diode (OLED) display, a Quantum Dot Light Emitting Diodes (QLED), a Curved surface display or other displays.

The different technical features of the above embodiments can have various combinations which are not described for the purpose of brevity. Nevertheless, to the extent the combining of the different technical features do not conflict with each other, all such combinations must be regarded as being within the scope of the disclosure.

The previously described implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A display driving method, comprising:

a) acquiring an original gray scale data group of each of pixel units of a content to be displayed in a preset display area;

b) determining average gray scales of each of hues in the preset display area according to the original gray scale data group;

c) acquiring original light source intensities of each of the hues of the content to be displayed in the preset display area; and d) dividing the original gray scale data group into a first gray scale data group and a second gray scale data group according to the original gray scale data group of each of the pixel units, the average gray scales of each of the hues, and the original light source intensities, and determining driving light source intensities of each of the hues in the preset display area comprising upon determining that the second gray scale data group is displayed, setting the driving light source intensity of the hue corresponding to the maximum gray scale of the average gray scales in the preset display area to be 0; wherein step (d) comprises:

i) determining the driving light source intensities of each of the hues in the preset display area according to the average gray scales of each of the hues; and ii) dividing the original gray scale data group into the first gray scale data group and the second gray scale data group according to the original gray scale data group of each of the pixel units, the original light source intensities, and the driving light source intensities, wherein step (d)(ii) comprises:

A) regarding the maximum gray scales of each of the hues as the gray scales of each of the hues of the first gray scale data group;

B) determining brightness ratios of the gray scales of each of the hues of the first gray scale group with respect to a full gray scale according to the gray scales of each of the hues of the first gray scale data group; and C) determining brightness ratios of the gray scales of each of the hues of the second gray scale group with respect to the full gray scale according to the brightness ratios of the gray scales of each of the hues of the first gray scale group with respect to the full gray scale, the original light source intensities, and the driving light source intensities, wherein a gray scale of each of the hues of the first gray scale data group is a maximum gray scale in the original gray scale data group and a gray scale of each of the hues of the second gray scale data group is 0 or is greater than a minimum gray scale in the original gray scale data group.

2. The display driving method according to claim 1, wherein after the step of dividing the original gray scale data group into the first gray scale data group and the second gray scale data group, the method further comprises:

acquiring an original display duration of the original gray scale data group; and continuously displaying the first gray scale data group and the second gray scale data group in the original display duration.

3. The display driving method according to claim 2, wherein each of the display duration of the first gray scale data group and the display duration of the second gray scale data group is a half of the original display duration.

4. The display driving method according to claim 1, wherein prior to the step of acquiring the original gray scale data group of each of the pixel units of the content to be displayed in the preset display area, the method further comprises:

dividing a display region of a liquid crystal display into at least two display areas, and regarding the display areas as the preset display area sequentially.

5. The display driving method according to claim 1, wherein the step of acquiring original light source intensities of each of the hues of the content to be displayed in the preset display area is:

acquiring the original light source intensities of the content to be displayed in the preset display area via a look-up table.

6. The display driving method according to claim 1, wherein the step of dividing the original gray scale data group into the first gray scale data group and the second gray scale data group, according to the original gray scale data group of each of the pixel units, the average gray scales of each of the hues, and the original light source intensities and determining the driving light source intensities of each of the hues in the preset display area comprises:

upon determining that the gray scales of each of the hues in the preset display area are the same original gray scale data group, dividing the original gray scale data group into the first gray scale data group and the second gray scale data group, wherein the gray scale of each of the hues of the first gray scale data group is a maximum gray scale in the original gray scale data group, the gray scale of each of the hues of the second gray scale data group is 0 or is a second maximum gray scale in the original gray scale data group; and determining the driving light source intensities of each of the hues in the preset display area according to the original light source intensities, the first gray scale data group, and the second gray scale data group.

7. A computer apparatus comprising a memory, a processor and a computer program stored on the memory and executable on the processor, wherein the processor executes the computer program to perform following steps:

a) acquiring an original gray scale data group of each of pixel units of a content to be displayed in a preset display area;

b) determining average gray scales of each of hues in the preset display area according to the original gray scale data group;

c) acquiring original light source intensities of each of the hues of the content to be displayed in the preset display area; and d) dividing the original gray scale data group into a first gray scale data group and a second gray scale data group according to the original gray scale data group of each of the pixel units, the average gray scales of each of the hues, and the original light source intensities, and determining driving light source intensities of each of the hues in the preset display area comprising upon determining that the second gray scale data group is displayed, setting the driving light source intensity of the hue corresponding to the maximum gray scale of the average gray scales in the preset display area to be 0; wherein step (d) comprises:

i) determining the driving light source intensities of each of the hues in the preset display area according to the average gray scales of each of the hues; and ii) dividing the original gray scale data group into the first gray scale data group and the second gray scale data group according to the original gray scale data group of each of the pixel units, the original light source intensities, and the driving light source intensities, wherein step (d)(ii) comprises:

A) regarding the maximum gray scales of each of the hues as the gray scales of each of the hues of the first gray scale data group;

B) determining brightness ratios of the gray scales of each of the hues of the first gray scale group with respect to a full gray scale according to the gray scales of each of the hues of the first gray scale data group; and C) determining brightness ratios of the gray scales of each of the hues of the second gray scale group with respect to the full gray scale according to the brightness ratios of the gray scales of each of the hues of the first gray scale group with respect to the full gray scale, the original light source intensities, and the driving light source intensities, wherein a gray scale of each of the hues of the first gray scale data group is the maximum gray scale in the original gray scale data group and a gray scale of each of the hues of the second gray scale data group is 0 or is greater than a minimum gray scale in the original gray scale data group.

8. The computer device according to claim 7, wherein after the step of dividing the original gray scale data group into the first gray scale data group and the second gray scale data group, further comprises:

acquiring an original display duration of the original gray scale data group; and continuously displaying the first gray scale data group and the second gray scale data group in the original display duration.

9. The computer device according to claim 8, wherein each of the display durations of the first gray scale data group and the display duration of the second gray scale data group is a half of the original display duration.

10. The computer device according to claim 7, wherein prior to the step of acquiring the original gray scale data group of each of pixel units of the content to be displayed in the preset display area, further comprises:

dividing a display region of a liquid crystal display into at least two display areas, and regarding the display areas as the preset display area sequentially.

11. The computer device according to claim 7, wherein the step of acquiring original light source intensities of each of the hues of the content to be displayed in the preset display area is:

acquiring the original light source intensities of the content to be displayed in the preset display area via a look-up table.

12. A computer apparatus comprising a memory, a processor and a computer program stored on the memory and executable on the processor, wherein the processor executes the computer program to perform following steps:

a) acquiring an original gray scale data group of each of pixel units of a content to be displayed in a preset display area;

b) determining average gray scales of each of hues in the preset display area according to the original gray scale data group;

c) acquiring original light source intensities of each of the hues of the content to be displayed in the preset display area; and d) dividing the original gray scale data group into a first gray scale data group and a second gray scale data group according to the original gray scale data group of each of the pixel units, the average gray scales of each of the hues, and the original light source intensities, and determining driving light source intensities of each of the hues in the preset display area, wherein step (d) comprises:

i) upon determining that the gray scales of each of the hues in the preset display area are the same original gray scale data group, dividing the original gray scale data group into the first gray scale data group and the second gray scale data group, wherein the gray scale of each of the hues of the first gray scale data group is the maximum gray scale in the original gray scale data group, the gray scale of each of the hues of the second gray scale data group is 0 or is a second maximum gray scale in the original gray scale data group; and ii) determining the driving light source intensities of each of the hues in the preset display area according to the original light source intensities, the first gray scale data group, and the second gray scale data group;

wherein a gray scale of each of the hues of the first gray scale data group is the maximum gray scale in the original gray scale data group and a gray scale of each of the hues of the second gray scale data group is 0 or is greater than a minimum gray scale in the original gray scale data group.

* * * * *